US007445497B2

(12) United States Patent
Zhang

(10) Patent No.: US 7,445,497 B2
(45) Date of Patent: Nov. 4, 2008

(54) ELECTRICAL CONNECTOR

(75) Inventor: Guo-Hui Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/894,146

(22) Filed: Aug. 20, 2007

(65) Prior Publication Data

US 2008/0045078 A1 Feb. 21, 2008

(51) Int. Cl.
*H01R 13/60* (2006.01)

(52) U.S. Cl. ..... 439/541.5; 439/326

(58) Field of Classification Search ..... 439/541.5, 439/326, 328, 637

See application file for complete search history.

(56) References Cited

U.S. PATENT DOCUMENTS 6,540,550 B2 * 4/2003 Chang et al. ..... 439/541.5
6,554,641 B1 * 4/2003 Wu ..... 439/541.5
6,699,068 B2 * 3/2004 Wu ..... 439/541.5
6,821,144 B2 * 11/2004 Choy ..... 439/541.5
7,008,262 B2 * 3/2006 Tsai ..... 439/541.5

* cited by examiner

*Primary Examiner*—Hien Vu
(74) *Attorney, Agent, or Firm*—Wei Te Chung

(57) ABSTRACT

An electrical connector in accordance with the present invention comprises an upper connector including an upper housing which defines an elongated first receiving slot and has a heighten portion below the receiving slot and a plurality of contacts retained in the upper housing, and a lower connector including an lower housing defining a second receiving slot and a plurality of contacts retained in the lower housing. The lower housing has a plurality of protruding portions on a rear surface thereof, the protruding portions face to a front surface of the heighten portion of the upper housing to space two adjacent rows of contacts respectively extending out from the upper housing and the lower housing.

7 Claims, 5 Drawing Sheets

ELECTRICAL CONNECTOR

BACKGROUND OF THE INVENTION

1. Field of the Invention

The present invention is generally related to an electrical connector, and especially to a double deck electrical connector soldered to a print circuit board and used for accommodating secondary print circuit boards, e.g., daughter board.

2. Description of Related Art

Most of double deck connectors for accommodating secondary print circuit boards (daughter board) existing in the prior arts includes an upper connector and a lower connector inserted into and occupy a lower space of the upper connector along a front-to-back direction so as to engaging with two secondary print circuit boards.

U.S. Pat. No. 6,821,144 discloses such an electrical connector described above, the electrical connector comprises an upper housing with an upper receiving slot for an insertion of an upper module, a lower housing with a lower receiving slot for an insertion of a lower module and a plurality of contacts arranged in parallel in the upper and lower receiving slots for electrically connecting with corresponding conductive contact pads of the modules. The lower housing is retained to the upper housing by being inserted into an opening space recessed rearward from a front surface of a lower portion of the upper housing. The contacts have tails extending out of bottom surfaces of corresponding housings and arranged in rows, each having a solder ball for being soldered to a print circuit board (mother board). Since the tails of two adjacent rows of the contacts respectively retained in the lower housing and the upper housing are very close to each other, when the lower module is inserting into the lower receiving slot by a strong force and pushes the lower housing move toward the upper housing, especially when the fasting means between the housings are not steady, it is easily for the two adjacent rows of the tails to touch with each other, that may cause shot circuit and influence a normal working of the modules.

Hence, an improved connector is highly desired to overcome the aforementioned disadvantages of the prior art.

SUMMARY OF THE INVENTION

Accordingly, an object of the present invention is to provide a double deck connector, which can prevented shot circuit between contacts.

To achieve the above object, an electrical connector comprises an upper connector, a lower connector assembled to the upper connector from a front side of the upper connector and a plurality of protruding portions. The upper connector includes an upper housing which defines an elongated first receiving slot and having a heightening portion below the first receiving slot, and a plurality of contacts retained in the upper housing. The lower connector includes a lower housing defining a second receiving slot and a plurality of contacts retained in the lower housing. All the contacts have contact portions correspondingly arranged in the first and the second receiving slots and tails extending out of bottom surfaces of the heightening portion and the lower housing in rows. The protruding portions are disposed between the lower housing and the heighten portion of the upper housing.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
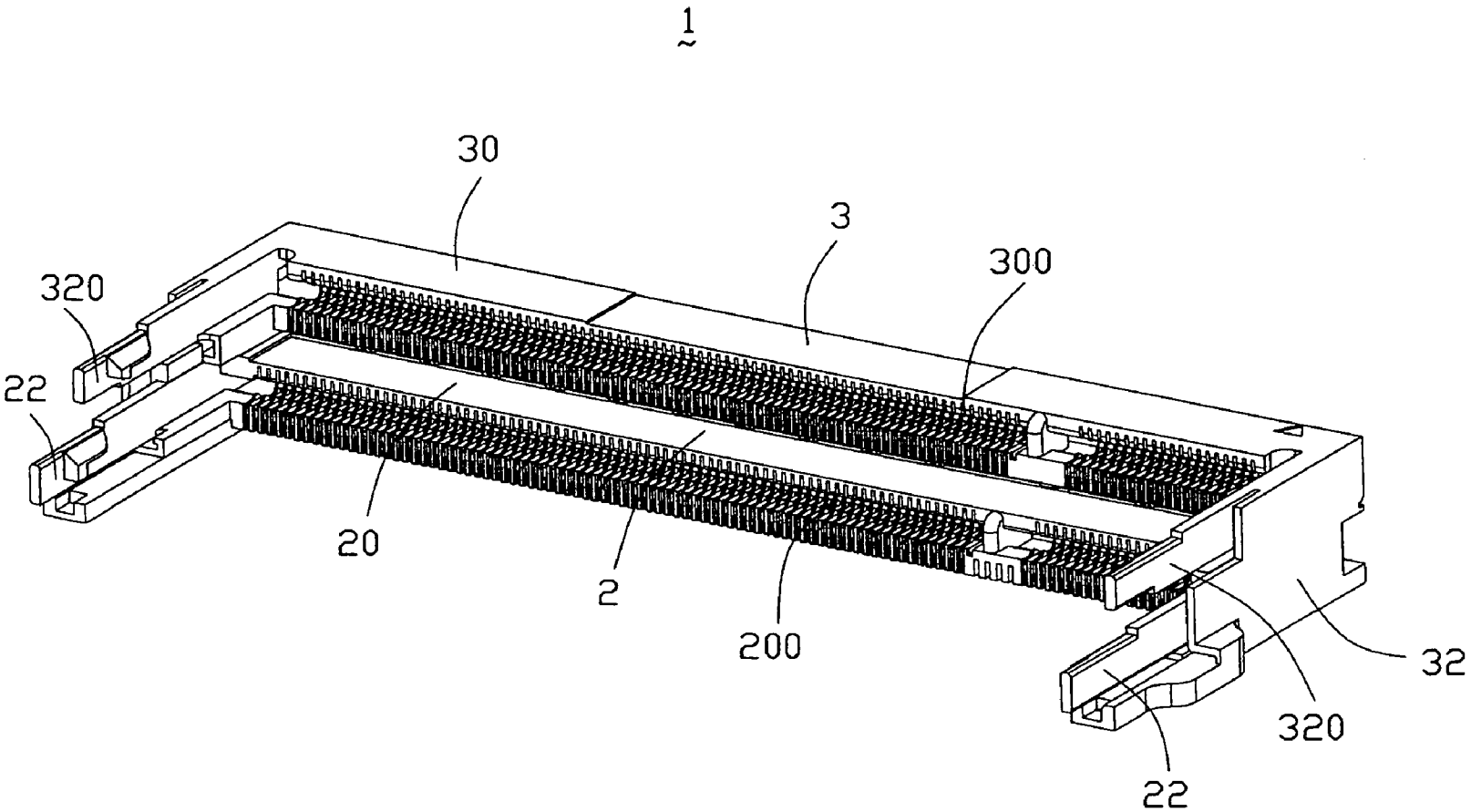
FIG. 1 is an assembled, perspective view of an electrical connector in accordance with the present invention.
Figure 2:
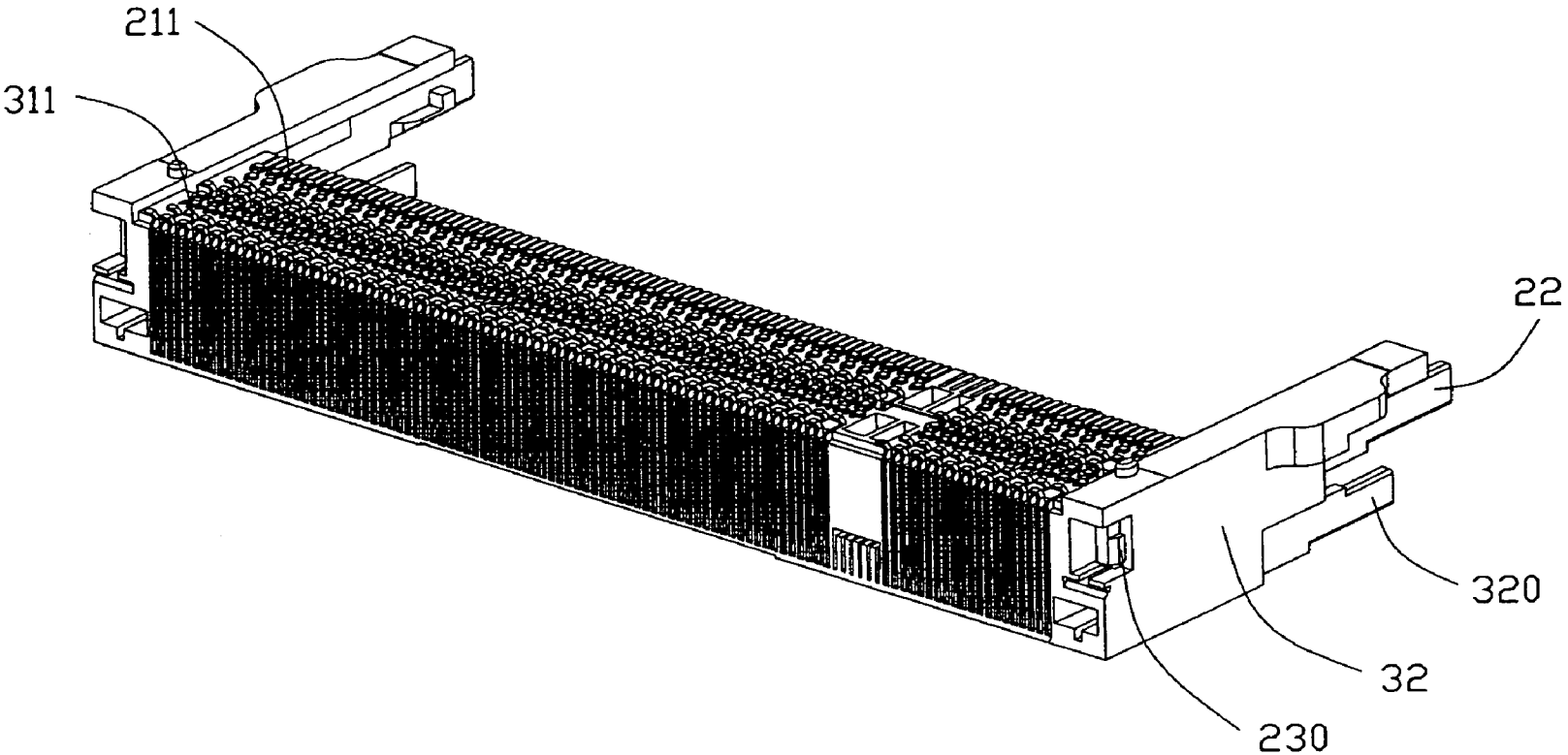
FIG. 2 is another assembled, perspective view of the electrical connector in accordance with the present invention.

Referring to FIG. 1, an electrical connector 1 in accordance with the present invention is a double deck connecter including a lower connector 2 and an upper connector 3 for accommodating two modules (not shown), simultaneity.

Figure 3:
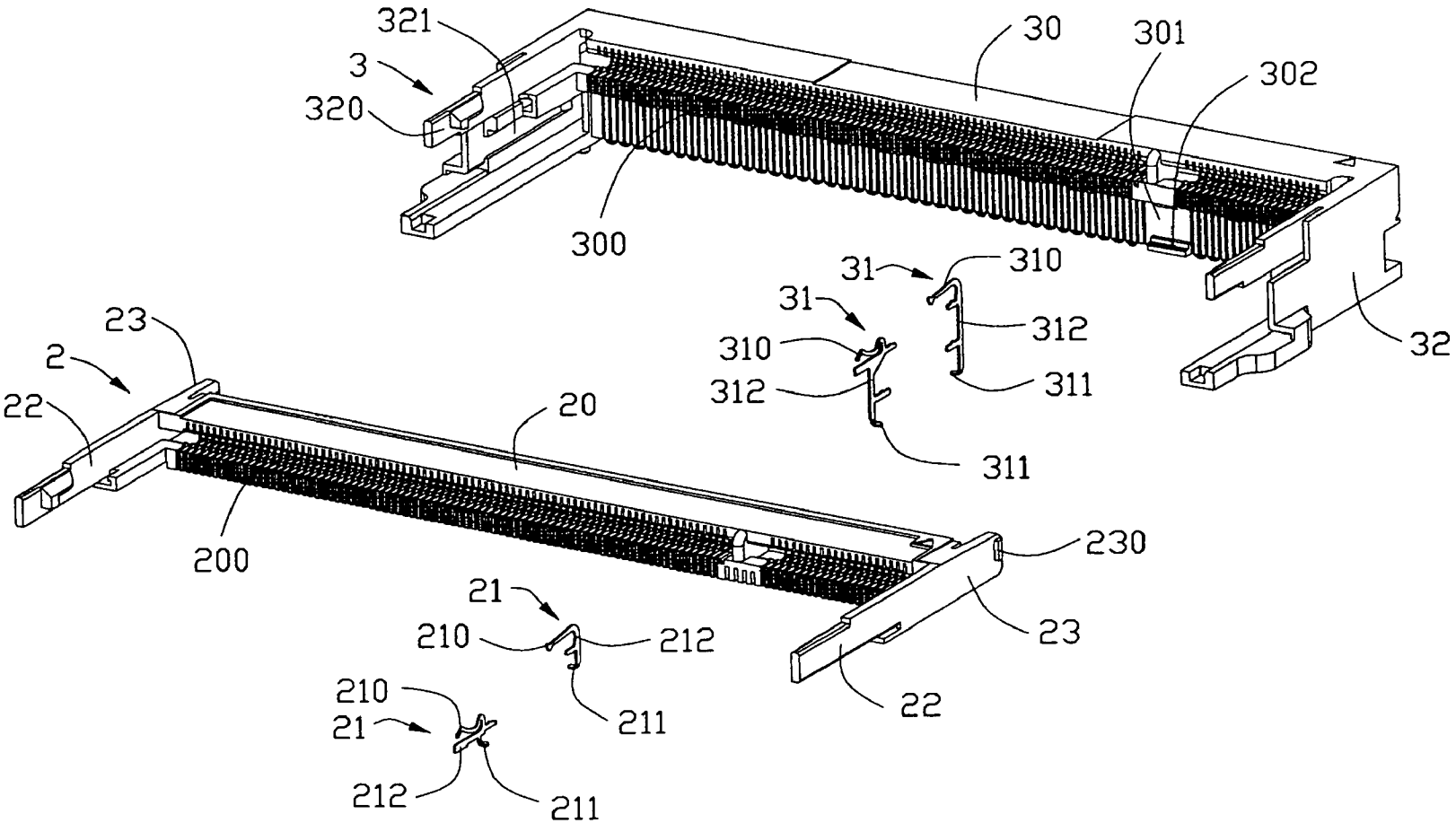
FIG. 3 is an exploded, perspective view of the electrical connector in accordance with the present invention.
Figure 4:
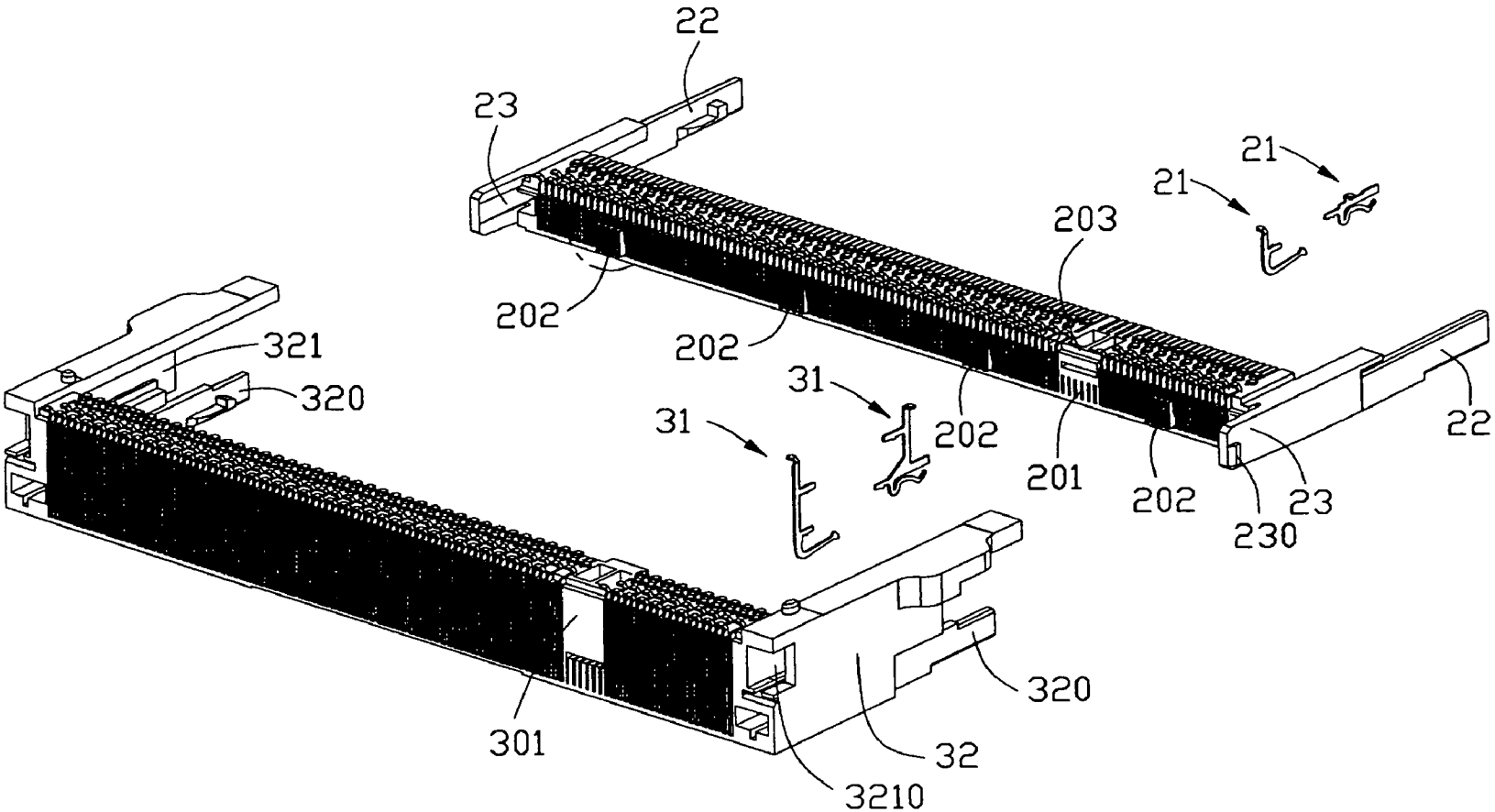
FIG. 4 is another exploded, perspective view of the electrical connector in accordance with the present invention.
Figure 5:
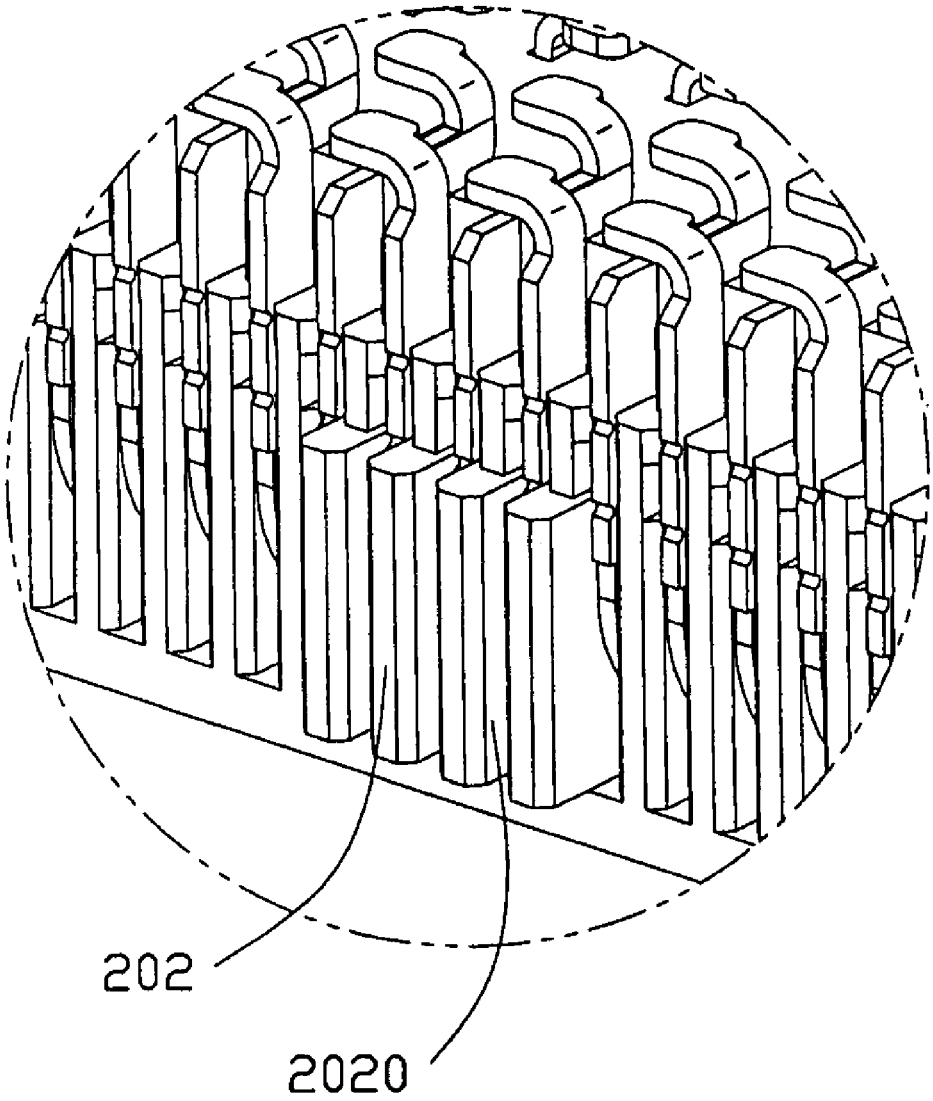
FIG. 5 is an enlarged view, showing a part of the electrical connector marked by a circle line in FIG. 4.

Referring to FIGS. 3-4, the lower connector 2 comprises a lower housing 20, which defines an elongated first receiving slot 200 for one of the modules inserting on a front surface (not labeled) thereof, a plurality contacts 21 mounted within the lower housing 20. The lower housing 20 has a pair of first latching arms 22 horizontally and forwardly extending from opposed ends thereof to fasten the module (not shown) inserted into the first receiving slot 200, and forming a clump 230 on a rear of the first latching arms 22 for engaging with the upper connector 3. Each contacts 21 has a contact portion 210 arranged in a side of the first receiving slot 200 for electrically contacting with the module (not shown), a tail 211 extending out of a bottom surface of the lower housing 20 for being soldered to a print circuit board (not shown) and a retaining portion 212 linking the contacting portion 210 and the tail 211 and retained in the lower housing 20 to mount the contact 21 to the lower housing 20.

The lower housing 20 has a rear surface 201 opposed to the front surface (not labeled). A plurality of protruding blocks 202 with a same height are provide in four groups along an elongated direction on the rear surface 201, and define a plurality of groove 2020 between two adjacent protruding blocks 202 in a same group for corresponding contacts 21 passing through to insert into the lower housing 20 from the rear surface 201. And a recess 203 is defined on a bottom edge of the rear surface 201.

The upper connector 3 includes an elongated upper housing 30 and a plurality of contacts 31 mounted within the insulating housing 30. The upper housing 30 comprises a heightened main body (not labeled) having a second receiving slot 300 for the other module (not shown) recessed from an upper part of a front surface of the main body, and a pair of side wall 32 extending forwardly from two opposed ends of the main body (not labeled). A lower part of the main body is a heightening portion 301 which make the upper housing 30 higher than the lower housing 20 and define a space (not labeled) below the second receiving slot 300 for accommodating a front part of the lower housing 20. The heightening portion 301 has a projecting portion 302 on a bottom edge of a front surface thereof for engaging with the recess 203 of the lower housing 20. The side walls 32 are formed with a pair of second latching arms 320 extending forwardly for latching two lateral sides of the module which is received in the second receiving slot 300, and a pair of guiding slots 321 extending along a front-to-back direction in inner sides thereof for guiding an insertion of the lower connector 2. The guiding slots 321 further pass through the upper housing 30 to define a pair of through holes 3210 on a rear surface of the upper housing 20 for engaging with the clump 230 of the lower housing 20.

Each contacts 31 has a contacting portion 310 arranged in a side of the second receiving slot 300 for electrically contact with the module (not shown), a tail 311 extending out of a bottom surface of the heightening portion 301 of the upper housing 30 for being soldered to the print circuit board (not shown) and a retaining portion 312 linking the contacting portion 310 and the tail 311 and retained in the upper housing 30 to mount the contact 31 to the upper housing 30.

When assembly, the lower connector 2 assembles to the upper connector 3 in a manner that the first latching arms 22 sliding along the guiding slot 321 toward the heighten portion 301 till the clumps 230 on the rear ends of the first latching arms 22 lock with the through holes 3210 on a rear surface of the upper connector 3. A front part of the lower housing 30 is located in the space (not labeled) below the second receiving slot 300, the protruding blocks 202 disposed on the rear surface of the lower housing 20 are face to or even abutting against the front surface of the heighten portion 301. All the tails 210, 310 of the contacts 21, 31 are extending out of bottom surface of the housings 20, 30 in several rows. When the module (not shown) inserts into the first receiving slot 200, the lower housing 20 will be pushed toward the upper housing 30, the protruding portions 202 between the housings 20, 30 can prevent the lower housing 20 from further closing the heighten portion 301 of the upper housing 30 to protect two adjacent rows of the contacts 21, 31 respectively mounted on the lower housing 20 and the upper housing 30.

This is a preferred embodiment, otherwise, the protruding portions 202 may also be formed on the front surface of the heighten portion 301 of the upper housing 30, instead of on the rear surface of the lower housing 20. And the protruding portions 202 may be a separate member, instead of being formed integrally with the housing 20 (30), and be attached to the housing 20 (30) by colloid after the contacts 21, 31 insert into the housings 20, 30.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an upper connector including an upper housing and a plurality of contacts retained in the upper housing, the upper housing defining an elongated first receiving slot and having a heightening portion below the first receiving slot, the contacts having contact portions arranged in sides of the first receiving slot and tails extending out of a bottom surface of the heightening portion in rows;

a lower connector including an lower housing defining a second receiving slot and a plurality of contacts retained in the lower housing, the contacts having contact portions arranged in sides of the second receiving slot and tails extending out of a bottom surface of the lower housing in rows, the lower connector assembled to the upper connector at a lower portion of a front side of the upper connector;

a plurality of protruding portions disposed between the lower housing and the heighten portion of the upper housing;

wherein at least one of the lower housing and the upper housing is integrally formed with the protruding portions;

wherein the protruding portions are arranged in several groups, two adjacent protruding portions in a same group define a groove therebetween for corresponding contact passing though;

wherein the lower housing is formed with a pair of first latching arms on opposed ends thereof, the first latching arm has a clump on a rear end thereof for engaging with the upper housing; and wherein the upper housing is formed with a pair of side walls on opposed ends thereof, the side walls defines a pair of elongated guiding slots along on inner side thereof for guiding an insertion of the lower housing.

2. The electrical connector according to claim 1, wherein the protruding portions are formed on a rear surface of the lower housing.

3. The electrical connector according to claim 1, wherein the protruding portions are formed on a front surface of the heightening portion of the upper housing.

4. The electrical connector according to claim 1, wherein the protruding portion is a separate member, and is attached to one of upper and lower housings by colloid after the contacts are inserted into the upper and lower housings.

5. The electrical connector according to claim 1, wherein the guiding slots of the upper housing define a pair of through holes on a rear surface of the upper housing, the clumps of the lower housing pass through the guiding slot and latch with corresponding sidewalls of the through holes.

6. A double deck electrical connector comprising:

an upper connector including an upper insulative housing with a horizontally extending upper elongated slot and a plurality of upper contacts located by upper and lower sides of said upper slot under a condition that the upper housing is configured to allow the upper contact on the upper side of the upper slot to be inserted into the upper housing from a rear face of the upper housing and the upper contact on the lower side of the upper slot to be inserted into the upper housing from a front face of the upper housing;

a heightening portion located below the upper slot for upward raising the upper slot at an upper level;

a lower connector including a lower insulative housing with a horizontally extending lower elongated slot and a plurality of lower contacts located by upper and lower sides of the lower slot under a condition that the lower housing is configured to allow the lower contact on the upper side of the lower slot to be inserted into the lower housing from a rear face of the lower housing and the lower contact on the lower side of the lower slot to be inserted into the lower housing from a front face of the lower housing;

the lower housing being essentially located at a lower level confronting the heightening portion in a front-to-back direction; wherein protrusion are formed and sandwiched between a rear face of the lower housing and a front face of the heightening portion so as to assure not shorting between the lower contacts on the upper side of the lower slot and the upper contacts on the lower side of the upper slot;

wherein said protrusions are integrally formed with one of the lower housing and the upper housing;

wherein the protruding portions are arranged in several groups, two adjacent protruding portions in a same group define a groove therebetween for corresponding contact passing though;

wherein the lower housing is formed with a pair of first latching arms on opposed ends thereof, the first latching arm has a clump on a rear end thereof for engaging with the upper housing; and wherein the upper housing is formed with a pair of side walls on opposed ends thereof, the side walls defines a pair of elongated guiding slots along on inner side thereof for guiding an insertion of the lower housing.

7. The electrical connector as claimed in claim 6, wherein said protrusion is integrally formed with the lower housing.

* * * * *